US005129376A

United States Patent [19]

Parmley

[11] Patent Number: 5,129,376

[45] Date of Patent: Jul. 14, 1992

[54] TELEPHONE AUTOMATIC CAR STARTER

[75] Inventor: Donald D. Parmley, Washington Park, Ill.

[73] Assignee: Rex H. Jackson, Collinsville, Ill.

[21] Appl. No.: 773,253

[22] Filed: Oct. 9, 1991

[51] Int. Cl.[5] ..... F02N 11/08

[52] U.S. Cl. ..... 123/179.2; 180/167; 290/38 C; 307/10.6

[58] Field of Search ..... 123/179.2; 180/167; 290/38 C, 38 E, 38 R; 307/10.6

[56] References Cited

U.S. PATENT DOCUMENTS

| | | | |
|---|---|---|---|
| 3,455,403 | 7/1969 | Hawthoren | 180/167 |
| 3,577,164 | 5/1971 | Bartelii et al. | 180/179 R |
| 4,227,588 | 10/1980 | Biancardi | 180/167 |
| 4,236,594 | 12/1980 | Ramsperger | 180/167 |
| 4,345,554 | 8/1982 | Hildreth | 123/179 BG |
| 4,392,059 | 7/1983 | Nespor | 123/179 B |
| 4,606,307 | 8/1986 | Cook | 123/179 B |
| 4,674,454 | 6/1987 | Phairr | 123/179 B |
| 5,000,139 | 3/1991 | Wong | 123/179.2 |

*Primary Examiner*—Andrew M. Dolinar
*Attorney, Agent, or Firm*—Don W. Weber

[57] ABSTRACT

A novel automatic remote car starting unit is presented which is activated by the audible signal from a telephone pager. The unit receives the audible signal from the pager and activates the ignition and throttle of a vehicle. Timers allow the ignition cycle to start the vehicle and shut off the unit if the car fails to start. The oil pressure and water temperature of the engine are monitored and the unit shuts off the car in case the oil pressure or water temperature become dangerous. The vehicle's air conditioning or heater may also be activated to cool or heat the car to a desired level. Once the engine is running and the desired climatic level is reached, the vehicle's horn signals that the car is ready to drive.

9 Claims, 5 Drawing Sheets

TELEPHONE AUTOMATIC CAR STARTER

BACKGROUND OF THE INVENTION

This invention relates generally to the field of automatic car starters, and more particularly to the field whereby a car is started from a remote location without the use of electrical wires or other mechanical connecting means.

Automatic remote car starters are well known in the art. Many improvements have been made on the initial remote car starters and the art describes various safety mechanisms and fail-safe devices for insuring that the car will either start automatically or that the starter will cease its action upon sensing that there is trouble in starting the engine. Most of the inventions described in the prior art involved remote car starters which were activated by means of a switch inside the house. These switches were mechanically connected to the car engine and starting device by means of electrical wiring. An improvement upon this particular type of starting method involved a radio transmitter and receiver. Such a patent was described by Phairr in U.S. Pat. No. 4,674,454. Another remote means involving a radio receiver in combination with the remote transmitter was described in the 1983 patent issued to Nespor, U.S. Pat. No. 4,392,059.

Most of the prior art involving automatic remote car starters utilized an expensive radio transmitter and receiver. While the receiver/transmitter mode of communicating the signal to the automobile was effective, it was also quite expensive. Although electrical wires were not needed, the device was limited in range to the range of the radio transmitter and receiver.

It is an object of this invention to provide an automatic remote car starter which is operated by means of the standard telephone. It is a further object of this invention to provide an automatic remote car starter which may be started at any distance from the automobile provided that a telephone is available. It is still a further object of this invention to provide an automatic remote car starter which has a number of fail-safe devices and convenience features for use by the owner of an automobile with such a device installed therein. Further objects of this invention will become obvious upon reading the following Specification.

BRIEF DESCRIPTION OF THE INVENTION

The instant device is an electronic unit which may be installed on a gas or diesel vehicle. The device may also be installed on other gas, diesel or electrically operated engines or machinery and would be particularly useful in the oil industry to start machinery by a telephone call. The device utilizes a standard telephone pager which produces an audible signal. This audible signal is detected by a sound sensor in the unit which then puts into operation the various parts of the automobile required to start the engine. The initial sound signal from the pager is transferred through a series of timers, vacuum controls, and other devices and ultimately reaches the starter relay switch, the ignition relay switch, the throttle and various other safety switches. Safety switches monitor the oil sending unit and temperature sending unit lights and provide for an automatic cut-off of the engine and operation of the device should certain temperatures be reached or should the oil pressure drop below a safe level. The device also operates the environmental control unit of the automobile and will either cool down the automobile to a specified temperature or heat up the interior of the automobile to a set desired climatic condition. Once the engine is running and the car reaches the desired temperature, the horn is activated to indicate that the car is ready to be occupied. Additional features allow automatic activation of the interior lights at night and to automatic activation of a garage door should the car be in a garage having a garage door opener.

Since the vehicle is initially started by means of a standard telephone pager, the car may be started from any location on the globe by means of a simple telephone call.

BRIEF DESCRIPTION OF THE DRAWING FIGURES

DETAILED DESCRIPTION OF THE PREFERRED EMBODIMENT

Figure 1:
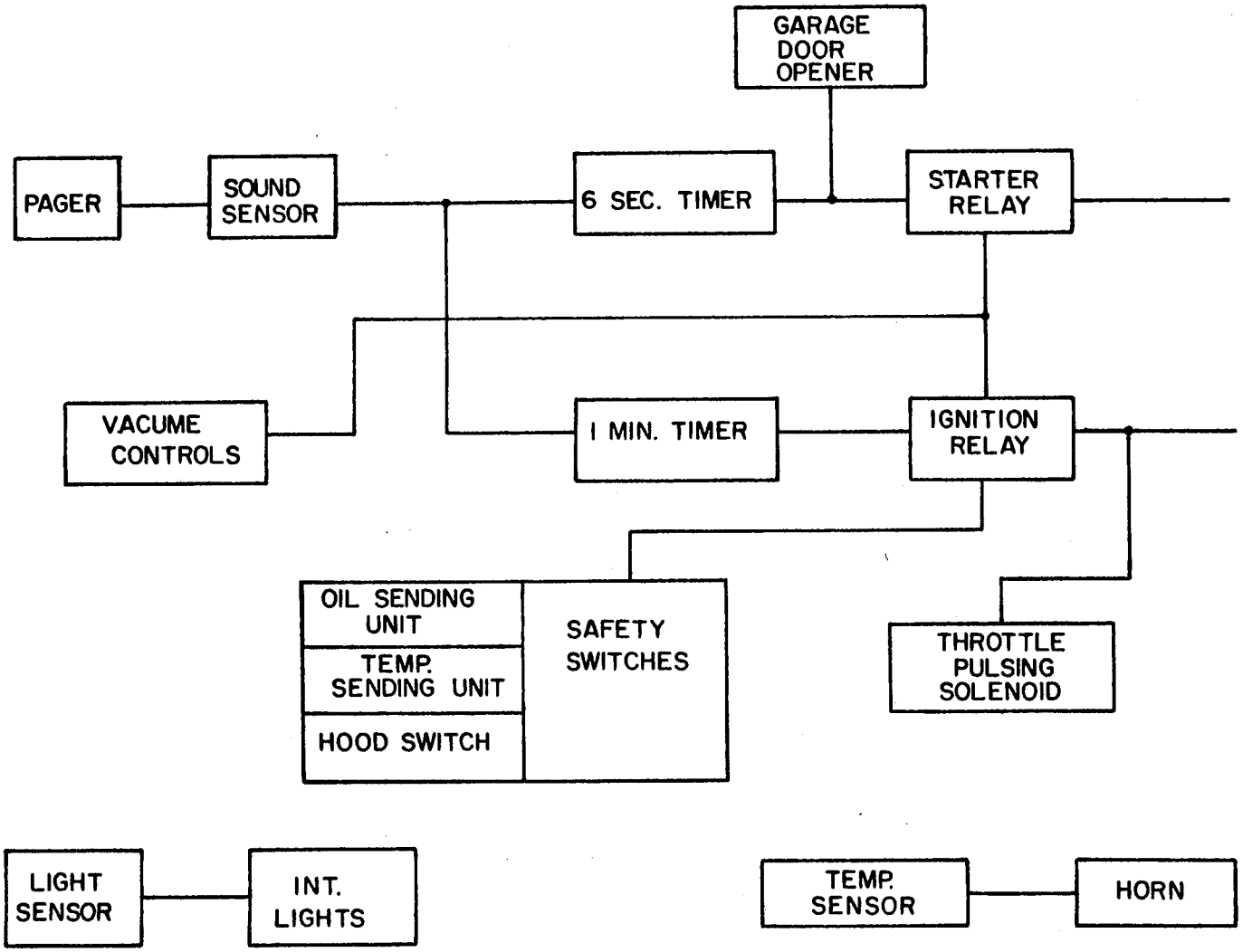
FIG. 1 is a block diagram showing the various functions and operations of the automatic remote starter unit.

The signal to start the vehicle is initiated by calling the telephone pager number. The telephone pager 1 is purchased separately and supplied by the user. Since the normal range of telephone pagers currently in use is approximately seventy-five (75) miles, the car could be started provided it is within the seventy-five (75) mile range of the pager system. The telephone call to activate the pager, however, could be made from anywhere in the world where a telephone is available.

The pager creates an audible sound when the correct number is dialed. An acoustical link shown generally at 2 links the pager, sound sensor 3 and buzzer 11. This acoustical link must be sound proof so as to eliminate exterior noise. The sound sensor 3 may be a standard microphone or other type of receiver pick-up. The sound sensor is operated by means of a six-volt power source 4 which may be in the form of a rechargeable battery supplied by the user. The sound sensor 3 should have two capacitors connected thereto to prevent the sensor from being accidentally tripped by flourescent lighting. In the event that a car is equipped with a standard shift, a shift jack 5 is provided. This jack 5 is connected to the emergency and neutral switches on the standard transmission car by means of the male jack 6. This circuit would include the parking brake mercury switch 7 and the standard transmission neutral switch 8. A five-volt relay 9 supplies current to the one-minute timer 12 which is tripped by the sound sensor 4. A second five-volt relay 10 is also triggered by the sound sensor. This second relay 10 triggers the on and off ignition latching relay switch 38 when activated by means of the audible signal from the pager.

In order to keep the sound sensor activated for a full minute, a second audible signal is placed into the circuit by the buzzer 11. This buzzer is also triggered by the pager 1. The one-minute main timer 12 is a heat-type, resetting lamp resistor heat coil. This timer is closed for one minute and activates the six-second timer 27 as best shown on FIG. 3 and the starter. This one-minute timer activates the system until the engine starts. Once that occurs, the vacuum switch 53 overrides the one-minute timer.

If the engine dies during the operation of the one-minute timer, the unit will restart the engine automatically. The circuitry will attempt to start the engine several times during the one-minute period. (This circuitry is designed into the system so that a hard starting engine may be accommodated.) If after one minute the engine does not start (engine failure) the unit will automatically shut down.

Figure 2:
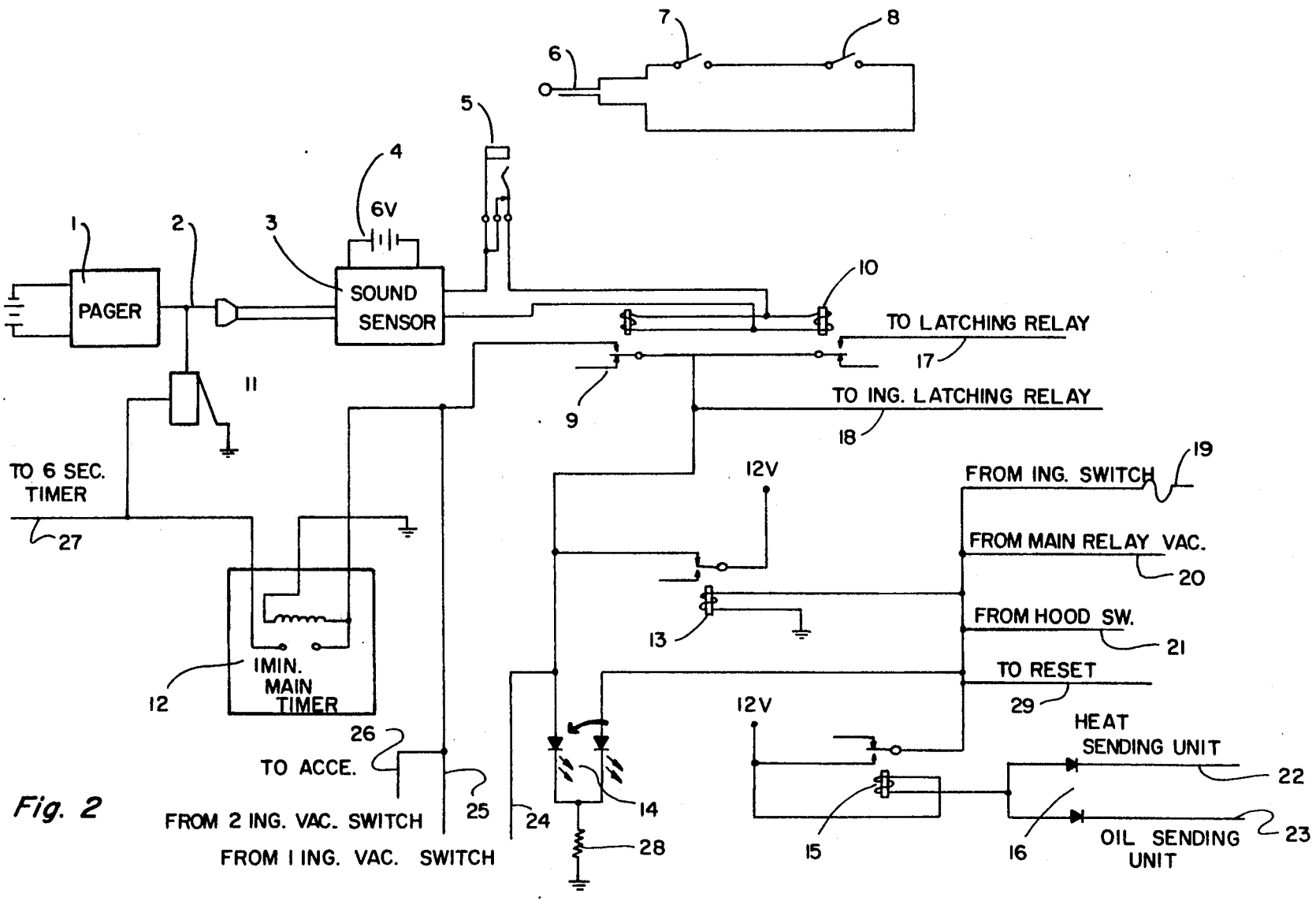
FIG. 2 is a schematic diagram showing the initial pager and sound sensor and related electronic systems.

The main relay 13 operates when the regular ignition key switch is in the "on" position. Red LED lights will be displayed when there is no power to the unit. The ignition key "on" position also resets the latching relay switch to "off." In this mode the unit is not activated. The green LED light indicates that power is being supplied to the unit. The combination red and green LED lights are shown at 14 (FIG. 2) and indicate the power "on" or "off" status for the unit. Since the automatic remote starter unit is concealed under the dash panel, these indicator lights are the visible means of alerting the user to the mode of operation of the unit at a particular time.

A twelve-volt relay 15 powers the main relay 13. The relay coil 15 is grounded to the heat sending unit 22 and the oil sending unit 23. Should the car heat up beyond a safe temperature or should the oil pressure drop below a safe pressure, the unit would stop the engine instantly. Diodes 16 in the heat sending circuit and the oil sending circuit allow the indicator lights to function properly under normal operation.

The relay 10 is electrically connected to a twelve-volt lamp 37 by means of current lead 17. The ignition current lead 18 connects the "off" and "on" latching relay switch 38 to the circuitry. The current lead from the twelve-volt power source to the ignition key switch is fed through a twenty ampere fuse 19. This fuse is spliced to the main relay 13 as shown on schematic FIG. 2. Current lead 20 runs between the main relay vacuum switch to the main relay 13.

A special safety device is shown at 21. The current lead 21 runs from under the hood where a mercury safety switch is electrically connected to the main relay 13. This mercury safety switch would cut off the power to the starting unit when major repairs are being made while the hood is in the "up" position.

The heat sending unit switch 22 and the oil unit sending switch 23 are connected to the ground. The current lead 24 is a twelve-volt lead connected to the first ignition vacuum switch as shown on FIG. 2. The twelve-volt current lead 25 is connected to the second ignition vacuum switch as shown. Another twelve-volt current lead 26 connects the unit to the accessories of the car which include the interior lights, throttle pulsing solenoid, horn temperature sensor, blower motor, air conditioning unit, and under hood grill chimes. These accessories alert the individual user that the vehicle is beginning the ignition process.

The six-second timer 30 is connected to the unit by means of the twelve-volt lead 27. This lead runs through the one-minute main timer 12 to the six-second timer.

The red and green LED lights are connected to the ground through a one hundred ohm resistor 28. Another twelve-volt current lead 29 runs from the key switch 19 to reset the latching relay 38. The latching relay is reset to the "off" position when the key in the ignition switch is in the "on" position.

Figure 3:
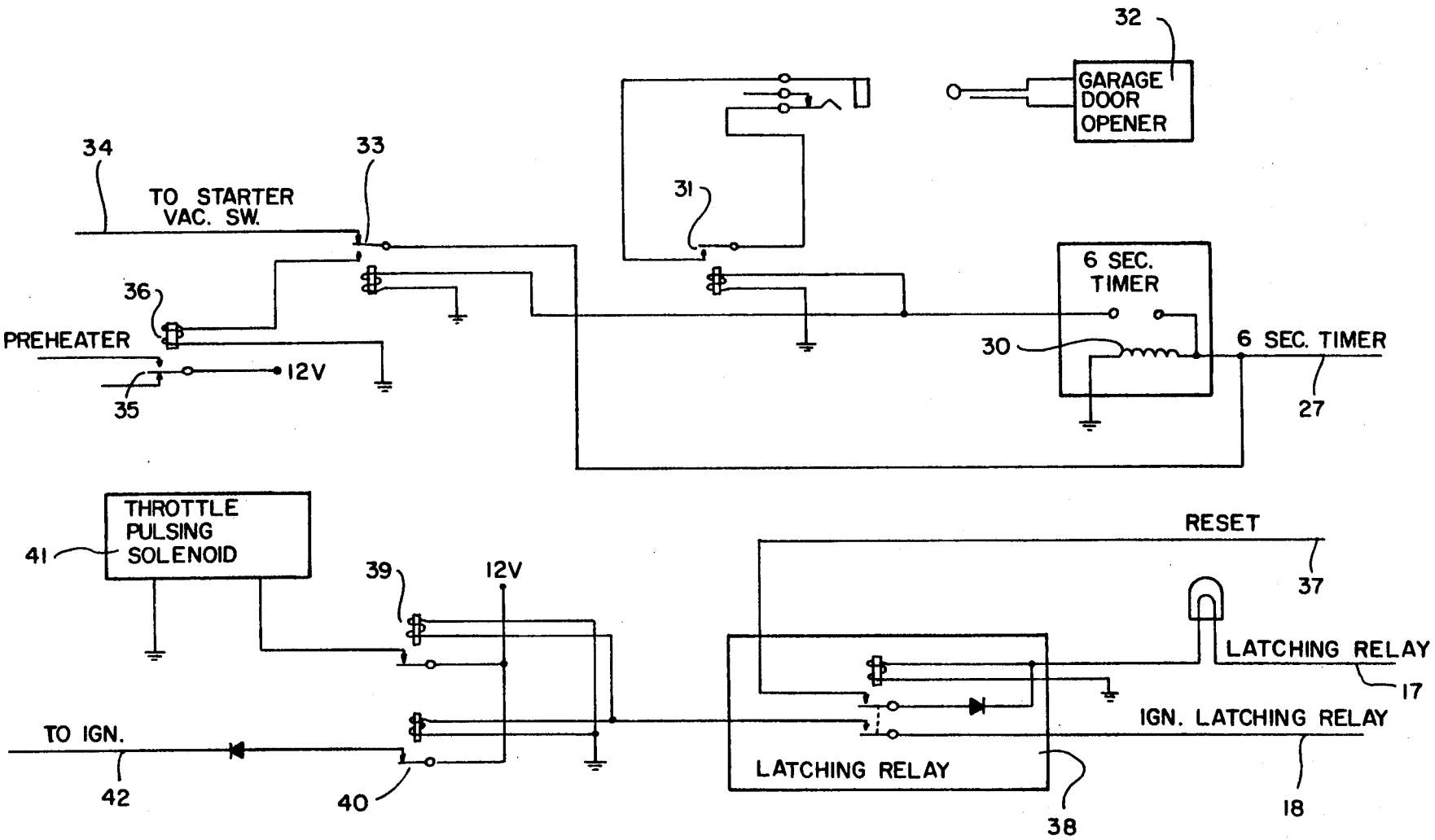
FIG. 3 is a continuation of FIG. 2 showing further parts of the schematic diagram.

Moving now to FIG. 3, the six-second timer 30 heat coil is used in applications for diesel engines and garage door openers. A diesel engine must be pre-heated before it is started. The six-second timer heat coil closes for six seconds to activate the diesel pre-heater and garage door opener simultaneously. Power to this six-second coil expires after the one-minute timer circuit opens. A twelve-volt relay 31 is activated by the six-second timer switch and automatically opens the garage door. The garage door opener 32 is supplied by the user and is an optional feature which may be accommodated by this remote control unit. A twelve-volt mini-relay 33 is engaged for six seconds by the timer putting current through a relay coil for the pre-heater when the coil 33 is disengaged. Electrical current from twelve-volt lead 27 is thus connected to the starter vacuum switch 34 for up to one minute during the operation of the unit. The lead to the starter vacuum switch 34 also runs through the starter vacuum kick-out switch. Another twelve-volt relay 35 runs to the pre-heater for diesel engines. (This lead is used only for cars with diesel engines.) Another relay 36 runs to the coil for the pre-heater relay.

A twelve-volt lamp 37 keeps the latching relay from accidentally re-triggering, as shown on FIG. 3. The latching relay shown generally at 38 receives a number of pulses from the circuit. The first pulse closes the relay. The second pulse opens the relay and turns the motor off. This second pulse also resets to "off" when the ignition key is in the "on" position. Another twelve-volt relay 39 is arranged in the circuit to accommodate the throttle pulsing solenoid. A vehicle ignition relay 40 activates the vehicle ignition system. For diesel engine applications this relay would activate the vehicle fuel pump.

A throttle pulsing solenoid 41 trips the choke on the car four to six times thus manipulating the gas feed prior to the engine starting cycle. This choke pulse may vary during the time that the engine is running in order to keep the engine cool when the air conditioner is on and to circulate coolant in the winter. A gas lead wire 42 runs to the ignition in a standard car. If a diesel car application is desired, the lead wire 42 would run to the fuel pump.

Figure 4:
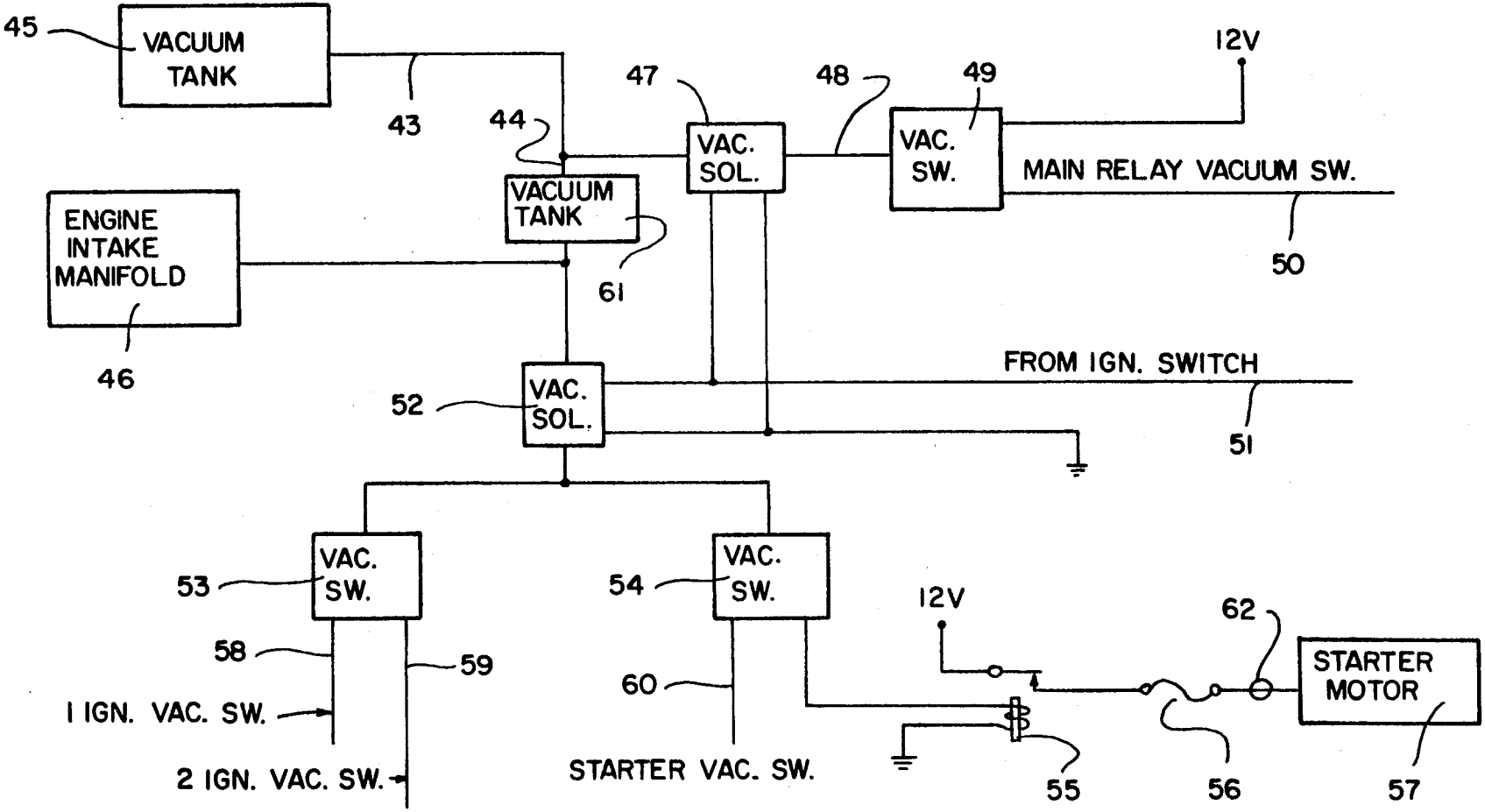
FIG. 4 is a continuation of the schematic of FIG. 3 showing the various connections to the starter motor and ignition system.

Moving now to schematic diagram FIG. 4, the vacuum tank 45 is shown. The main vacuum line supply is shown at 43. A one-way check valve 44 is inserted between the vacuum flow and the storage vacuum tank 45. This vacuum storage tank is present in the system to provide a thirty to forty second delay in turning on the power to the unit after the engine is turned off. The engine intake manifold 46 is the main source of the vacuum. A vacuum solenoid 47 is closed when the ignition key is in the "on" position. A pin-hole size vacuum orifice (shown generally at 48 drilled into the neck vacuum switch 49) bleeds air into the hole in the base of the vacuum switch 49. The vacuum switch 49 keeps the main relay 13 in the "off" position until the vacuum bleeds off from the vacuum storage tank 45 through the orifice 48.

The main relay vacuum switch 50 delays the surge of power to the unit for thirty to forty seconds after the engine is turned "off." This device will make an audible clicking noise when the ignition key is shut off. A line 51 from the ignition key switch closes vacuum solenoid 47 and 52 to block any vacuum from reaching the ignition vacuum switch 53, the starting vacuum switch 54, and the vacuum orifice 48, under normal operating conditions. The vacuum solenoid and relief valve 52 closes when the ignition key is "on" and releases pressure on the ignition vacuum switch and starting vacuum switch immediately upon activation. The ignition vacuum switch 53 is an override switch which keeps the motor running while the ignition is on when a pre-determined vacuum pressure is reached. The starting vacuum switch 54 is "off" when a vacuum is applied and that, in turn, turns the starter motor to the "off" position.

A heavy-duty relay 55 is utilized to start the starting motor. This relay is connected to the starter motor 57 through a re-settable fuse. This re-settable fuse 56 sets the starter motor off and breaks the circuit in case the starter drive does not engage after a few seconds. The starter motor 57 is shown of FIG. 4.

The ignition circuit is operated essentially through the ignition vacuum switch 53. A twelve-volt lead wire 58 runs between the first ignition (see FIG. 2, number 24) to the vacuum switch 53. A second twelve-volt lead wire 59 runs from the ignition vacuum switch 53 to the latching relay switch 17, shown on FIG. 2. Another twelve-volt lead wire 60 runs to the starter vacuum switch from the starter vacuum switch 34 and the twelve-volt mini-relay 33.

A vacuum tank 61 stores the vacuum until the motor is running in an efficient manner. At that point, the starting vacuum switch 54 turns off the circuit to the starter motor 57. The neutral safety switch current 62 must go through the neutral safety switch in applying current to the starter motor.

Figure 5:
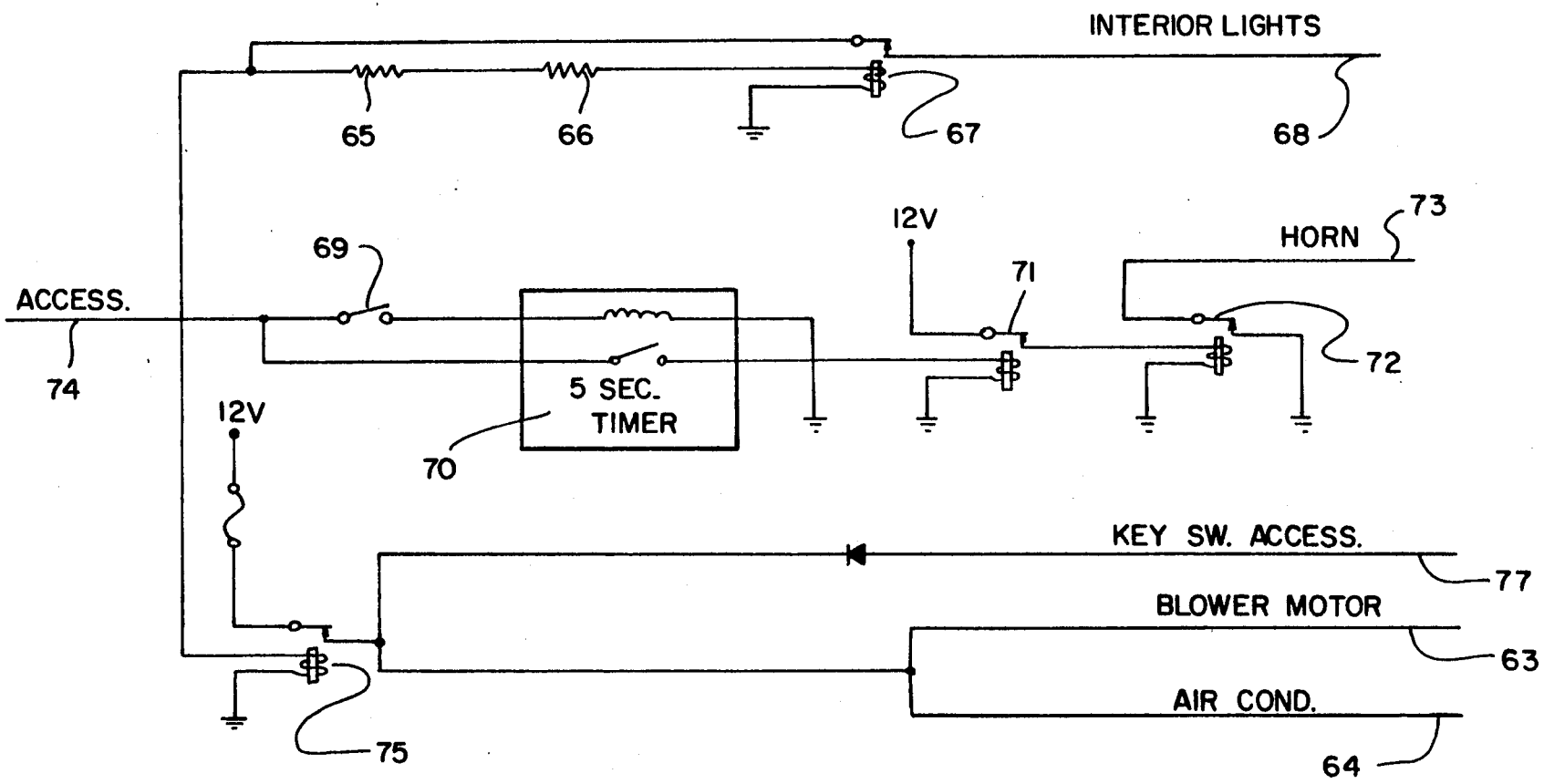
FIG. 5 shows the schematic diagram for various connections to the interior lights, horn, and climatic control systems.

Turning now to schematic drawing FIG. 5, the unit is now ready to activate the various accessories, lights, horn, and climatic control units. A twelve-volt power supply 63 is supplied to the heater and air conditioner blower motor switch speed control. Another twelve-volt power supply 64 is connected to the air conditioner switch control. A resistor 65 turns on a photo cell 66 when the vehicle interior is dark and the unit is in use. This photo cell is located on the inside of the vehicle and automatically senses the amount of light available. Should the amount of light be minimal, the photo cell resistor 65 and photo cell 66 turn on the vehicle interior lights so as to light the way for the user of the unit. The interior lights are operated by means of a five-volt mini-relay 67. This mini-relay is connected to a twelve-volt relay 68. The necessity of using both a five-volt and a twelve-volt relay is found due to the fact that vehicles' wiring vary as to the positive or negative grounding.

A thermostat switch 69 is located in the circuit between the accessories 74. If this thermostat is set at a standard climatic temperature of seventy (70) degrees Fahrenheit, a five-second timer 70 will honk the horn for five seconds when the temperature reaches the desired seventy (70) degree Fahrenheit on the interior of the vehicle. This temperature may be set to either operate the air conditioning to cool the car in the summer or to operate the heater to warm the car in the winter. This five-second timer 70 audibly announces to the user that the car is in condition for driving. A twelve-volt mini-relay 71 activates a twelve-volt mini-relay 72. This twelve-volt mini-relay 72 is for the horn. The horn ground lead 73 is placed in the steering wheel wiring horn circuit. This horn ground lead is triggered for five seconds by the thermostat switch 69 when the desired temperature is reached. The standard accessories connected to the unit ignition switch are also connected through the accessory line 74 to the thermostat switch 69. A heavy-duty twelve-volt relay 75 and a twenty amp fuse supplies a twelve-volt current to the blower motor switch and the air conditioner "off" and "on" switch. A heavy-duty diode 76 is placed in the circuit to prevent power feedback to the regular ignition on some vehicles which activate the main relay 13 in normal operation. Another lead 77 operates between the regular ignition key switch accessories to the air conditioner blower motor power switch.

For diesel and gas engines, a diode 76 is also placed into the circuit. In the use of diesel engines, wintertime starting may be difficult. When the engine cranks, the power lead from the starter relay switch 55 also puts a twelve-volt power current to either bomb starting kit to insure starting in the winter. This additional kit is supplied by the user.

For starting emergency vehicles such as fire trucks, ambulances or other emergency apparatus the use of this unit cannot only start the engine but also open the door for the emergency vehicle to exit.

A credit card number may also be used to access the remote starter unit. Using this credit card number would mean that no false calls or accidental random dialing would start the vehicle.

As can be seen from the above described schematics, this vehicle may be started by means of a simple phone call. The starter is operated by a vacuum switch which is also released once the motor is started. Another vacuum switch operates the ignition and a solenoid works the throttle so that enough revolutions are provided to trip the choke on the vehicle. The ignition switch, of course, would override the entire circuitry. Due to the unique circuitry herein the throttle is pumped once every few seconds to keep the car revving at the proper and efficient rate.

Having fully disclosed my new invention, I claim:

1. An automatic remote engine starter, comprising:

(a) a sound sensor adapted to detect a remotely activated audible signal;

(b) a means for activating the ignition system of a vehicle by a pulse from said sound sensor;

(c) a means for activating the throttle of a vehicle by a pulse from said sound sensor;

(c) a safety means for disengaging the ignition and throttle means should the engine not start after a set time period.

2. An automatic remote engine starter as in claim 1, wherein said remotely activated audible signal is a telephone pager.

3. An automatic remote engine starter as in claim 1, wherein said safety means comprises a one-minute timer, a six-second timer and oil and temperature monitoring means.

4. An automatic remote engine starter as in claim 1, further comprising a means for activating the interior lights of a vehicle.

5. An automatic remote engine starter as in claim 4, wherein said light means comprises a photo electric sensing cell.

6. An automatic remote engine starter as in claim 1, further comprising a means for activating the heating systems of the vehicle to heat the interior of the vehicle to a desired temperature.

7. An automatic remote engine starter as in claim 1, further comprising a means for activating the air conditioning system of the vehicle to cool the interior of the vehicle to a desired temperature.

8. An automatic remote engine starter as in claim 7, further comprising a means for signalling when the climatic condition of the interior of the vehicle meets a desired temperature.

9. An automatic remote engine starter as in claim 1, further comprising a means for activating a garage door opener by a pulse from said sound sensor.

* * * * *